United States Patent [19]

Peilet

[11] 4,184,279

[45] Jan. 22, 1980

[54] BRUSH OR OTHER IMPLEMENT AND DISPLAY CARD THEREFOR

[76] Inventor: Lester R. Peilet, 6144 N. Talman Ave., Chicago, Ill. 60659

[21] Appl. No.: 856,726

[22] Filed: Dec. 2, 1977

[51] Int. Cl.[2] ..... G09F 3/00

[52] U.S. Cl. ..... 40/314; 15/184; 206/232; 206/361

[58] Field of Search ..... 15/184; 40/314, 2 R, 40/21 R, 20 A, 19, 322; 206/361, 362.2, 362.3, 362.4, 232, 482

[56] References Cited

U.S. PATENT DOCUMENTS

| | | | |
|---|---|---|---|
| 1,938,442 | 12/1933 | Stuart | 206/362.4 X |
| 1,955,920 | 4/1934 | Kress | 40/314 |
| 2,690,863 | 10/1954 | Adelman | 40/322 |
| 3,040,352 | 6/1962 | Vian | 206/361 X |

*Primary Examiner*—John F. Pitrelli

*Attorney, Agent, or Firm*—Burmeister, York, Palmatier, Hamby & Jones

[57] ABSTRACT

An implement-display card combination, comprising an implement, such as a brush or a scoop, with a body and a generally flat handle extending laterally therefrom, such handle having two opposite sides with edge portions therebetween formed with edgewise projections, a display card made of flexible sheet material and wrapped around the handle, such display card having a first panel adjacent one side of the handle, plus second and third panels connected to the first panel by folds and folded around the handle into superimposed relation adjcent the opposite side of the handle, such display card having openings therein disposed along the folds and receiving the edgewise projections on the handle to retain in the display card on the handle, and means such as adhesive material for securing the second and third panels together in superimposed relation. The illustrated display card has a foldable tab extending into a hanger hole in the handle. In one embodiment, as indicated, the implement is a brush, in which the handle has a flat surface in a plane extending perpendicular to the bristles of the brush. The handle is made of a thermoplastic material so that the flat surface is receptive to the impression of a hot stamp. The other side of the handle may have a reinforcing rib to give the handle a limited flexibility. In another embodiment, the implement is a scoop having a bottom wall with a multiplicity of openings therein. Such bottom wall is generally parallel with the flat surface of the handle.

7 Claims, 17 Drawing Figures

20
26
32
30
56
14
76
14
22
70
58
50
64
48
36
34

58
74
22
54
34
56
48
62
20
26
36

42
44
24
30
40
28

26
20
36
34
44
38
46
48
22
46
34
48
36
24
26

22
50
52
54
56
58
60
62
64
66
68
70
72
74
76

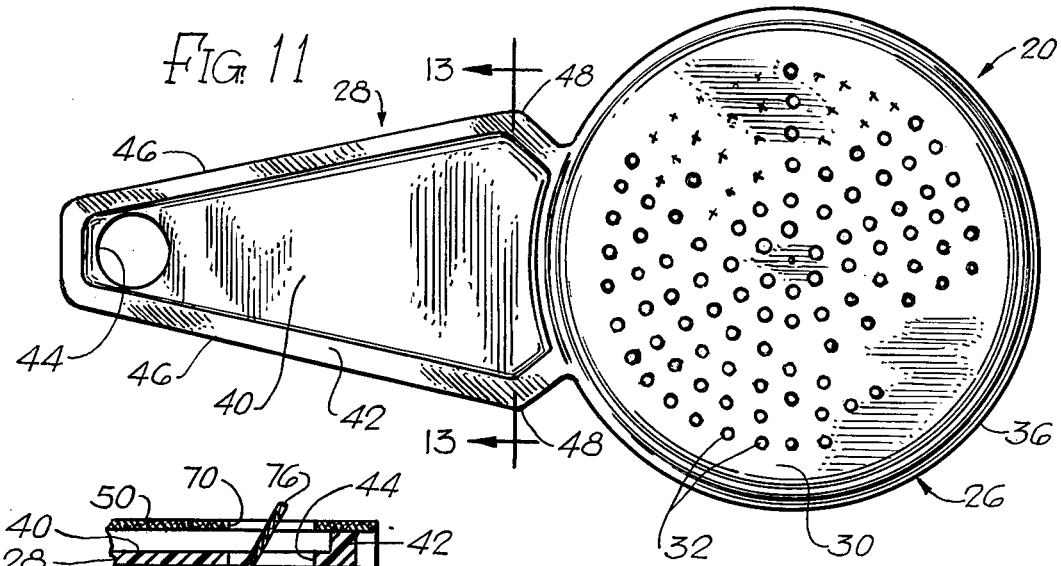
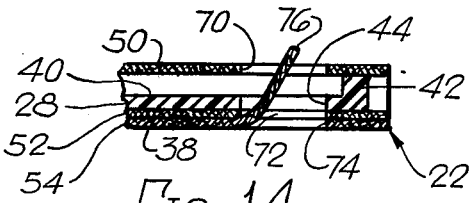
FIG. 14
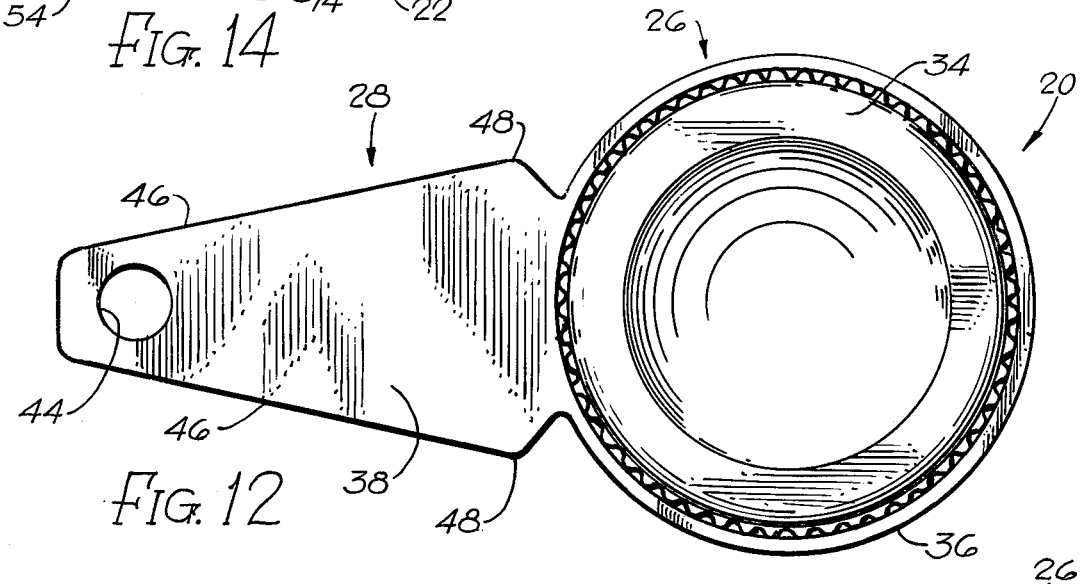
FIG. 12
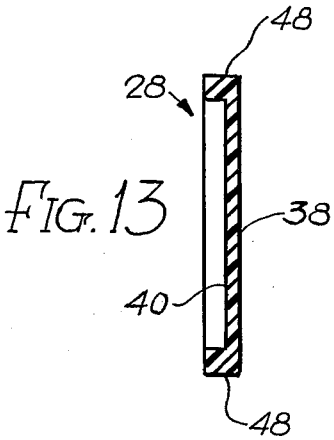
FIG. 13
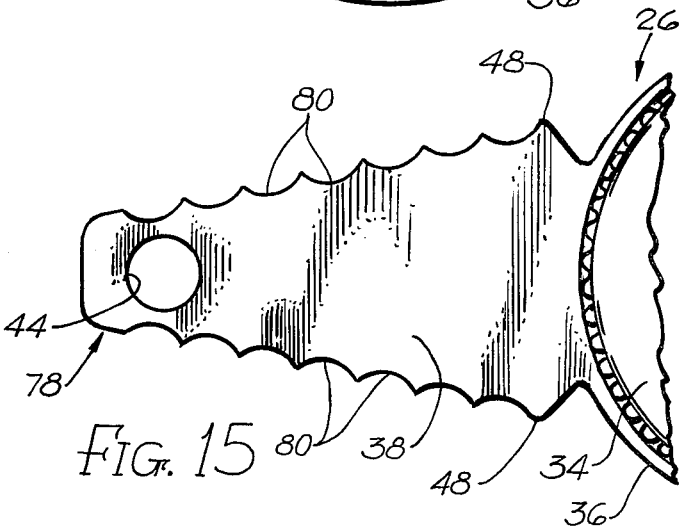
FIG. 15

BRUSH OR OTHER IMPLEMENT AND DISPLAY CARD THEREFOR

This invention relates to an implement, such as a brush or a scoop, together with a display card for such implement.

One object of the present invention is to provide an implement together with a display card which is retained thereon in an effective yet economical manner.

A further object is to provide a new and improved brush or other implement having a handle which is receptive to a hot stamp for imprinting an advertising message or the like.

Another object is to provide a new and improved implement in the form of a scoop having a bottom wall with a multiplicity of openings therein.

To achieve these objectives, the present invention may provide an implement-display card combination, comprising an implement with a body and a generally flat handle projecting laterally therefrom, a display card made of flexible sheet material and wrapped around the handle, such display card having a first panel adjacent one side of the handle, plus second and third panels connected to the first panel by folds and wrapped around the handle into superimposed relation adjacent the opposite side of the handle, and adhesive material or other means securing the second and third panels together in superimposed relation, the handle and the display card having interlocking elements for retaining the display card on the handle.

Such interlocking elements may comprise edgewise projections on opposite edges of the handle, and openings in the display card for receiving the edgewise projections. There may be two such openings disposed along the folds between the first panel and the second and third panels.

The handle may have an end portion with a hanger hole therein. The display card may have aperture means opposite such hole and a foldable tab extending into the hole for retaining the display card on the handle. The implement may take the form of a brush having bristles thereon. The handle may have a flat side extending in a plane which is substantially perpendicular to the direction of the bristles. The other side of the handle may have a peripheral reinforcing rib to give the handle a limited flexibility.

Preferably, the handle is made of a thermoplastic material, so that the flat surface of the handle is receptive to the impression of a hot stamp, for imprinting an advertising message or the like upon the handle.

In another embodiment, the implement is in the form of a scoop having a bottom wall with a multiplicity of openings therein for draining liquids or the like from the scoop. Such bottom wall may be generally parallel with the flat surface of the handle.

Further objects, advantages and features of the present invention will appear from the following description, taken with the accompanying drawings, in which:

FIG. 11 is a top plan view of the retractable brush.

FIG. 12 is a bottom plan view.

FIG. 13 is a cross section, taken generally along the line 13—13 in FIG. 11.

FIG. 14 is a framentary section, taken generally as indicated by the line 14—14 in FIG. 1.

FIG. 15 is a fragmentary view, similar to a portion of FIG. 12, but showing a modified construction.

Figures 1, 2, 3, 4:
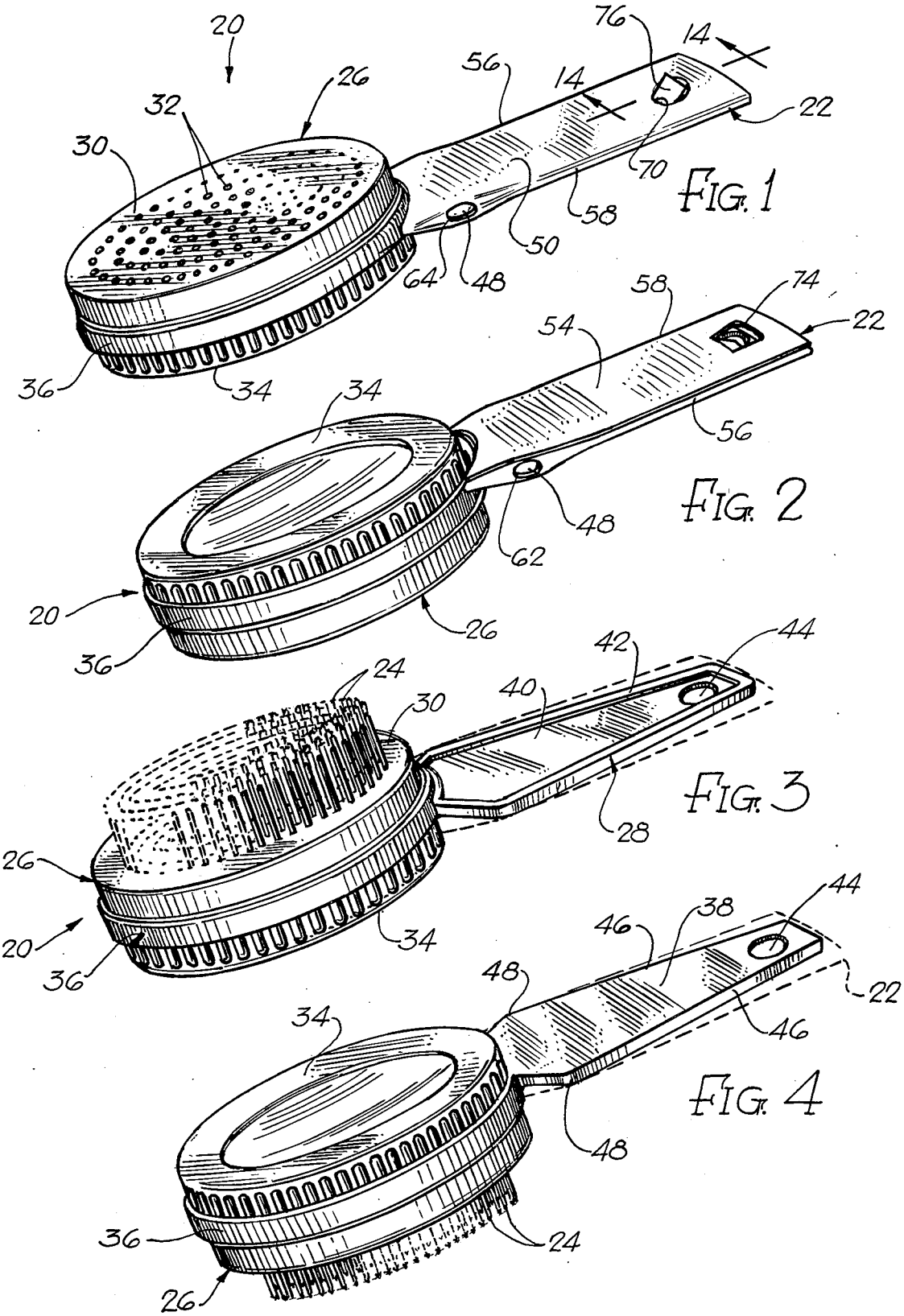
FIG. 1 is a perspective view of an implement in the form of a retractable brush, in combination with a display card, to represent one illustrative embodiment of the present invention.
FIG. 2 is a perspective view similar to FIG. 1, but with the retractable brush inverted.
FIG. 3 is a perspective view, showing the retractable brush with its bristles extended and with the display card removed.
FIG. 4 is a perspective view similar to FIG. 3, but with the brush inverted.

As indicated above, FIGS. 1–14 illustrate an implement 20 in combination with a display card 22. The illustrated implement 20 is in the form of a brush, which in this instance has retractable bristles 24. The present invention is also applicable to brushes with fixed bristles, as well as to other implements. The illustrated brush 20 has a body 26 with a generally flat handle 28 projecting laterally therefrom. The display card 22 is adapted to be mounted on the handle 28.

The retractable brush 20 may be of the general construction disclosed in the Kaye and Tate U.S. Pat. No. 2,865,039, issued Dec. 23, 1958; the Peilet et al. U.S. Pat. No. 2,916,756, issued Dec. 15, 1959; the Peilet et al. U.S. Pat. No. 3,059,259, issued Oct. 23, 1962; the Peilet U.S. Pat. No. 3,065,757, issued Nov. 27, 1962; or the Peilet U.S. Pat. No. 4,001,910, issued Jan. 11, 1977.

When extended, the bristles 24 project from the front wall 30 of the body 26, generally perpendicular to the front wall. The bristles 24 are adapted to be extended and retracted through a multiplicity of openings 32 in the front wall 30. It will be seen that the front wall 30 is substantially flat and circular in shape.

The brush 20 is provided with means for extending and retracting the bristles 24. In the illustrated brush 20 such means include a rotatable back member 34 on the body 26. The illustrated back member 34 is substantially circular and cupshaped. The rotation of the back member 34 relative to the body 26 operates an internal mechanism within the body 26 so as to extend and retract the bristles 24. Rotation of the back member 34 in one direction, such as clockwise, for example, causes the bristles 24 to be extended. Rotation of the back member 34 in the opposite direction causes the retraction of the bristles 24. The brush 20 has a self-cleaning action, whereby any hair and other foreign materials are automatically stripped from the bristles 24 as they are retracted through the openings 32 into the body 26.

The body 26 and the handle 28 are preferably molded in one piece from a resinous plastic material, preferably a thermoplastic material, such as polyethylene or polypropylene, for example. The rotatable back member 34 may also be molded from a resinous thermoplastic material.

The bristles 24 may be of the tufted type having a multiplicity of strands or fibers in each tuft. However, the illustrated bristles 24 are of the single type, such as those disclosed in the Peilet U.S. Pat. No. 4,001,910, issued Jan. 11, 1977. The bristles 24 are also preferably molded from a resinous thermoplastic material, such as polyethylene or polypropylene. Preferably, all of the bristles 24, together with a mounting plate, which is movable within the body 26, are molded in one piece.

The brush 20 may be used for personal hair grooming. The brush 20 is also useful for animal hair grooming. It will be understood that the brush 20 may be employed for any other desired uses.

The illustrated body 26 is generally cup-shaped. In addition to the flat front wall 30, the body 26 has a circular, generally cylindrical side wall 36, from which the handle 28 extends, generally in a radial direction.

The handle 28 of the illustrated brush 20 is generally flat and is provided with two opposite side surfaces 38 and 40. The side surface 38 is substantially flat and is in a plane which is generally perpendicular to the direction of the bristles 24. The plane of the surface 38 is generally parallel to the flat front wall 30. The opposite side surface 40 is substantially parallel with the flat surface 38.

To provide a handle which has a degree of flexibility, but is not overly flexible, it is perferred to provide reinforcing means for the handle. As shown, the handle 28 is formed with a reinforcing ridge or rib 42 which preferably extends around the perimeter of the side surface 40. The reinforcing ridge 42 stiffens the handle 28 to a degree, but provides a controlled flexibility, so that the handle 28 will flex appreciably when used for brushing hair. The working flexibility of the handle 28 makes it easy for the user to regulate the brushing pressure when the brush is in use for grooming hair.

It is highly advantageous to provide the unbroken flat surface 38 on the handle 28, and to make the handle of a thermoplastic material, so that the surface 38 is receptive to the impression of a hot stamp, for imprinting an advertising message, or any other message, on the handle of the brush. The large unbroken flat surface 38 makes it easy to imprint a lengthy or large advertising message or display on the handle 28.

The illustrated handle 28 is formed with a hanger hole 44 in the outer end portion of the handle. The hole 44 makes it possible to hang the brush 20 on a hook, nail or the like.

The illustrated handle 28 has a pair of edge surfaces or portions 46 extending between the side surfaces 38 and 40. Along such edge portions 46, the handle 28 has a pair of edgewise projections 48, forming the widest portion of the handle 28. The width of the handle tapers in both directions from the edgewise projections 48.

As previously indicated, the display card 22 is adapted to be mounted on the handle 28. The display card 22 may be made of a flexible sheet material, such as cardboard or the like.

Figures 5, 6, 7, 8, 9, 10:
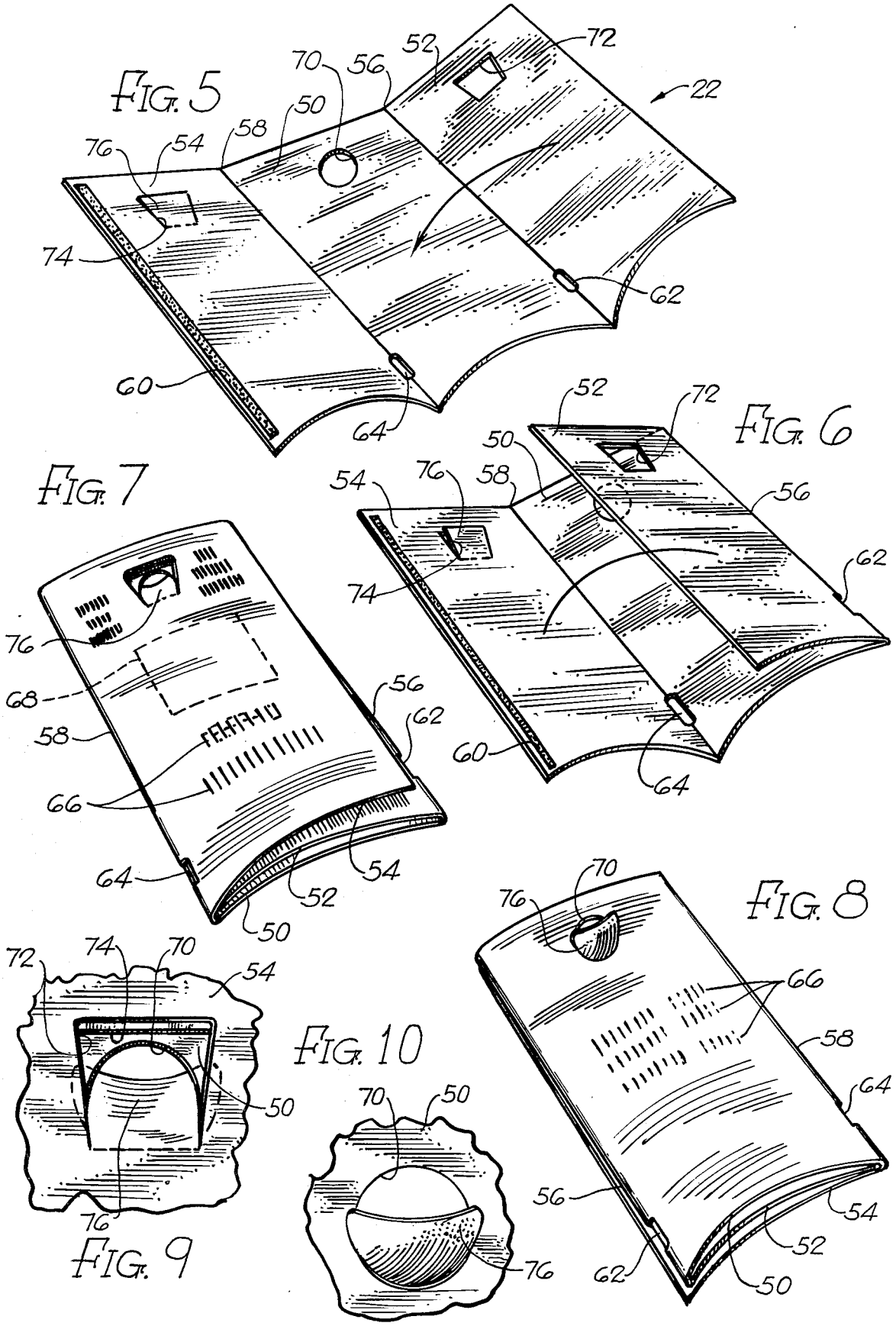
FIG. 5 is a perspective view showing the display card, before being wrapped into its condition of use.
FIGS. 6 and 7 are perspective views showing successive stages in the wrapping of the display card.
FIG. 8 is a perspective view similar to FIG. 7, but with the display card inverted.
FIGS. 9 and 10 are fragmentary enlarged perspective views similar to portions of FIGS. 7 and 8.

As shown to best advantage in FIGS. 5–8, the illustrated display card 22 preferably comprises a first or central panel 50, plus second and third panels 52 and 54, connected to the central panel 50 by folds 56 and 58. The display card 22 is adapted to be wrapped around the handle 28. The wrapping or folding of the display card 22 can be done either before or after the display card is mounted on the handle 28. FIGS. 5–8 illustrate the successive steps of wrapping or folding the display card 22. It will be seen that the side panels 52 and 54 are folded successively into superimposed relation, opposite the central panel 50. The side panels 52 and 54 are then secured together in superimposed relation, by suitable securing means, such as adhesive material or mechanical fasteners, such as staples. FIG. 6 illustrates the use of adhesive material 60 as the securing means. In this case, the adhesive material is applied in the form of a stripe on one of the side panels 52 or 54, but the adhesive material may be applied either locally or generally between the side panels 52 and 54. It will be evident that the folded or wrapped display card 22 is in the form of a flat tube, adapted to receive the handle 28. When wrapped around the handle 28, the central panel 50 of the display card is opposite one of the side surfaces 38 or 40, in this case the side surface 40. The side panels 52 and 54 are in superimposed relation, opposite the other side surface, in this case the side surface 38.

The handle 28 and the display card 22 preferably have interlocking elements for retaining the display card 22 on the handle 28. In this case, the edgewise projections 48 on the handle 28 act as such interlocking elements, in that the projections 48 are adapted to interlock with openings 62 and 64 in the display card 22. The openings 62 and 64 are preferably disposed along the respective folds 56 and 58. The edgewise projections 48 on the handle 28 project outwardly into the openings 62 and 64, as shown in FIGS. 1 and 2.

It will be understood that any desired labelling information may be printed on the display card 22. Such labelling information may include printed legends 66 and one or more pictures 68, as indicated in FIGS. 7 and 8.

The illustrated display card 22 is formed with aperture means opposite the hanger hole 44 in the handle 28 of the brush 20. As illustrated in FIGS. 5–10, such aperture means may include a hole 70 in the central panel 50, plus slots 72 and 74 in the side panels 52 and 54. One of the side panels 52 or 54 is preferably formed with a foldable tab 76, adapted to be folded into the hanger hole 44, so as to interlock with the handle 28, to assist in retaining the display card 22 on the handle. In this case, the foldable tab 76 is formed on the side panel 54 and is adapted to be folded out of the slot 74 and through the slot 72, the hanger hole 44 and the hole 70, as shown to best advantage in FIG. 14. The tab 76 is also shown in FIGS. 5–10. The foldable tab 76 is preferably keystone shaped in that it increases in width toward its extremity, to assist in retaining the tab 76 within the hanger hole 44.

FIG. 15 illustrates a modified handle 78 having a series of fingergrip notches or recesses 80, formed in each of its edge portions. Otherwise, the handle 78 may be the same as the handle 28. Corresponding components have been given the same reference characters in FIG. 15 as in the previous Figures.

Figure 16:
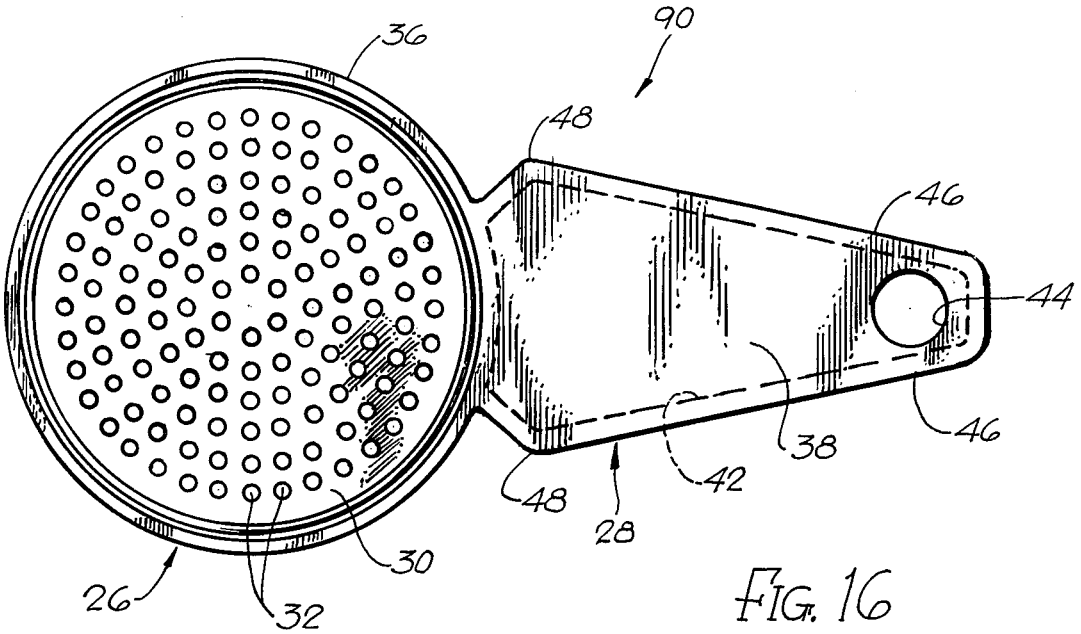
FIG. 16 is a plan view of a scoop, constituting another embodiment of the present invention.
Figure 17:
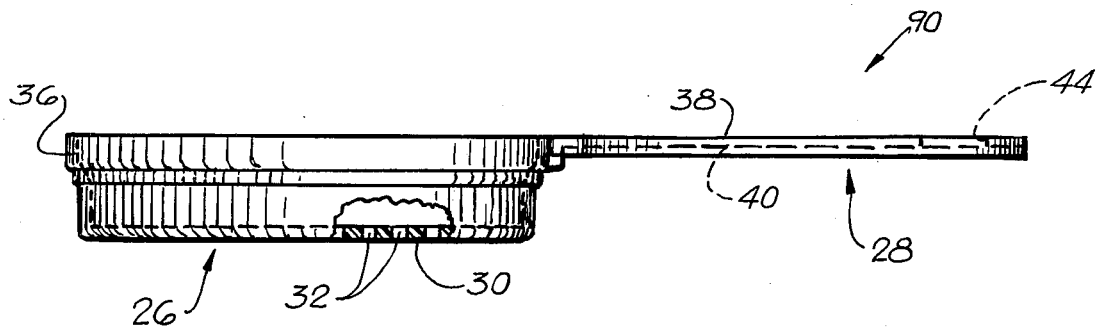
FIG. 17 is an elevational view of the scoop, partly in longitudinal section.

FIGS. 16 and 17 illustrate a modified implement in the form of a scoop 90, which employs the body 26 and the handle 28, as previously described, while omitting the bristles 24, the rotatable back member 34 and the internal mechanism which was used for advancing and retracting the bristles 24. The cup-shaped body 26 thus becomes a scoop with its handle 28. The flat wall 30 serves as the bottom wall of the scoop, while the generally cylindrical wall 36 serves as the side wall. The openings 32 serve to drain liquids from the scoop. It has been found that the scoop 90 of FIGS. 16 and 17 is useful as an egg scoop, which may be used for removing poached eggs from hot water. The scoop 90 can also be used as a sieve or strainer. The scoop is applicable to any other desired uses.

The handle 28 is exactly the same as previously described. Thus, the display card 22 may be mounted on the handle 28 of the scoop 90. Moreover, an advertising message may be imprinted on the flat surface 38 of the handle 28 by using a hot stamp. Any other message or design may be similarly imprinted, as desired.

It will be evident that the implement-display card combination is highly advantageous. Moreover, the implement itself has highly advantageous features.

I claim:

1. An implement-display card combination, comprising an implement with a body and a generally flat handle projecting laterally from said body, a display card made of flexible sheet material and wrapped around said handle, said handle having two opposite sides, said display card having a first panel adjacent one side of said handle, said display card having second and third panels connected to said first panel by folds and wrapped around said handle into superimposed relation adjacent the opposite side of said handle, and means securing said second and third panels together in superimposed relation, said handle and said display card having interlocking elements for retaining said display card on said handle, said interlocking elements comprise edgewise projections on opposite edges of said handle, and openings in said display card for receiving said edgewise projections.

2. An implement-display card combination according to claim 1, in which there are two of said openings disposed in said display card along the folds between said first panel and said second and third panels.

3. An implement-display card combination according to claim 2, in which said handle includes an end portion having a hanger hole therein, said display card having aperture means opposite said hole and a foldable tab extending into said hole and interlocking therewith.

4. An implement-display card combination, comprising an implement with a body and a generally flat handle projecting laterally from said body, a display card made of flexible sheet material and wrapped around said handle, said handle having two opposite sides, said display card having a first panel adjacent one side of said handle, said display card having second and third panels connected to said first panel by folds and wrapped around said handle into superimposed relation adjacent the opposite side of said handle, and means securing said second and third panels together in superimposed relation, said handle and said display card having interlocking elements for retaining said display card on said handle, said interlocking elements comprise an end portion on said handle having a hanger hole therein, said display card having aperture means opposite said hole, and a foldable tab on said display card extending into said hole to interlock therewith.

5. An implement-display card combination according to claim 4, including adhesive material forming said means for securing said second and third panels together.

6. An implement-display card combination, comprising an implement with a body and a generally flat handle extending laterally from said body, said handle having two opposite sides with edge portions therebetween, said edge portions having edgewise projections thereon, a display card made of flexible sheet material and wrapped around said handle, said display card having a first panel adjacent one side of said handle, said display card having second and third panels connected to said first panel by folds and folded around said handle into superimposed relation adjacent the opposite side of said handle, said display card having openings therein disposed along the folds between said first panel and said second and third panels said openings receiving said edgewise projections on said handle to retain said display card on said handle, and means securing said second and third panels together in superimposed relation.

7. An implement-display card combination according to claim 6, in which said handle includes a portion with a hanger hole therein, said display card having aperture means opposite said hole, said display card having a foldable tab extending into said hole for retention of said display card on said handle.

* * * * *